US009357311B2

(12) United States Patent
Xu et al.

(10) Patent No.: US 9,357,311 B2
(45) Date of Patent: May 31, 2016

(54) MINIATURE SPEAKER

(71) Applicants: Yunxia Xu, Shenzhen (CN); Bin Cai, Shenzhen (CN)

(72) Inventors: Yunxia Xu, Shenzhen (CN); Bin Cai, Shenzhen (CN)

(73) Assignees: AAC Microtech (Changzhou) Co., Ltd., Changzhou (CN); AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/559,348

(22) Filed: Dec. 3, 2014

(65) Prior Publication Data

US 2015/0319535 A1 Nov. 5, 2015

(30) Foreign Application Priority Data

Apr. 30, 2014 (CN) ..... 2014 2 0221686 U

(51) Int. Cl.

| | |
|---|---|
| ***H04R 9/06*** | (2006.01) |
| ***H04R 9/02*** | (2006.01) |
| ***H04R 7/18*** | (2006.01) |
| ***H04R 9/04*** | (2006.01) |

(52) U.S. Cl.

CPC ..... *H04R 9/025* (2013.01); *H04R 7/18* (2013.01); *H04R 9/045* (2013.01); *H04R 9/06* (2013.01); *H04R 2307/207* (2013.01); *H04R 2499/11* (2013.01)

(58) Field of Classification Search

CPC ..... H04R 1/24; H04R 7/04; H04R 7/12; H04R 7/18; H04R 9/025; H04R 9/045; H04R 9/06; H04R 9/063; H04R 9/10; H04R 2209/026; H04R 2499/11; H04R 1/021; H04R 2231/003; H04R 2307/207

USPC ..... 381/332, 334, 335, 182, 186, 386, 396, 381/398, 401, 412, 420, 421, 430, 431; 455/569.1, 575.1; 181/144, 145, 199

See application file for complete search history.

(56) References Cited

U.S. PATENT DOCUMENTS

| | | | | |
|---|---|---|---|---|
| 6,654,475 | B2 * | 11/2003 | Nakaso | H04R 7/12 381/396 |
| 6,744,895 | B2 * | 6/2004 | Miyamoto | H04R 9/063 381/182 |
| 7,519,191 | B2 * | 4/2009 | Enomoto | H04R 9/025 381/186 |
| 2012/0008810 | A1 * | 1/2012 | Lu | H04R 1/021 381/332 |

* cited by examiner

*Primary Examiner* — Huyen D Le
(74) *Attorney, Agent, or Firm* — Ipro, PLLC; Na Xu

(57) ABSTRACT

The present disclosure provides a speaker. The speaker includes a frame, a magnetic circuit system disposed within the frame, and a vibrating system disposed above the magnetic circuit system and connected with the frame. The vibrating system includes a diaphragm that includes a vibrating portion having a far portion away from the magnetic circuit system and an adjacent portion adjacent to the magnetic circuit system. An avoid part for avoiding the adjacent portion is disposed at a position on the magnetic circuit system that corresponds to the adjacent portion of the diaphragm which ensures the maximum amplitude of the diaphragm to avoid noises that would be generated due to collision with the magnetic circuit system when the vibrating system operates at the maximum amplitude.

7 Claims, 2 Drawing Sheets

MINIATURE SPEAKER

FIELD OF THE INVENTION

The present disclosure relates to an acoustic device, and more particularly to a miniature speaker.

DESCRIPTION OF RELATED ART

With the advent of the mobile Internet times, the smart mobile apparatuses are used in many fields. Among all kinds of mobile apparatuses, the mobile phones are obviously the most common and most portable mobile terminal apparatuses. Currently, the mobile phones are developed to have light weight and low profile. Among the many functions performed by a mobile phone, the high-quality music function is undoubtedly one of the functions that are deemed to be important. The speakers in the portable electronic apparatuses such as the mobile terminal apparatuses are just one of the essential conditions for achieving the high-quality music function.

The speaker of related art usually comprises a frame, a magnetic circuit system received within the frame, and a vibrating system disposed above the magnetic circuit system and fixed to the frame. The vibrating system comprises a diaphragm and a voice coil fixed below the diaphragm. Usually each vibrating system has maximum amplitude, and when the vibrating system operates at the maximum amplitude, the diaphragm might collide with the magnetic circuit system to generate noises that would compromise the performances. With the thickness of the speaker remaining unchanged, the only solution to avoid this problem is to reduce the thickness of the magnetic circuit system. However, reducing the thickness of the magnetic circuit system will compromise the performances of the speaker.

Accordingly, the present disclosure provides a novel miniature speaker to overcome the aforesaid shortcomings.

DETAILED DESCRIPTION OF THE INVENTION

Hereinbelow, the present disclosure will be described in detail with reference to the attached drawings and an embodiment thereof.

Figure 1:
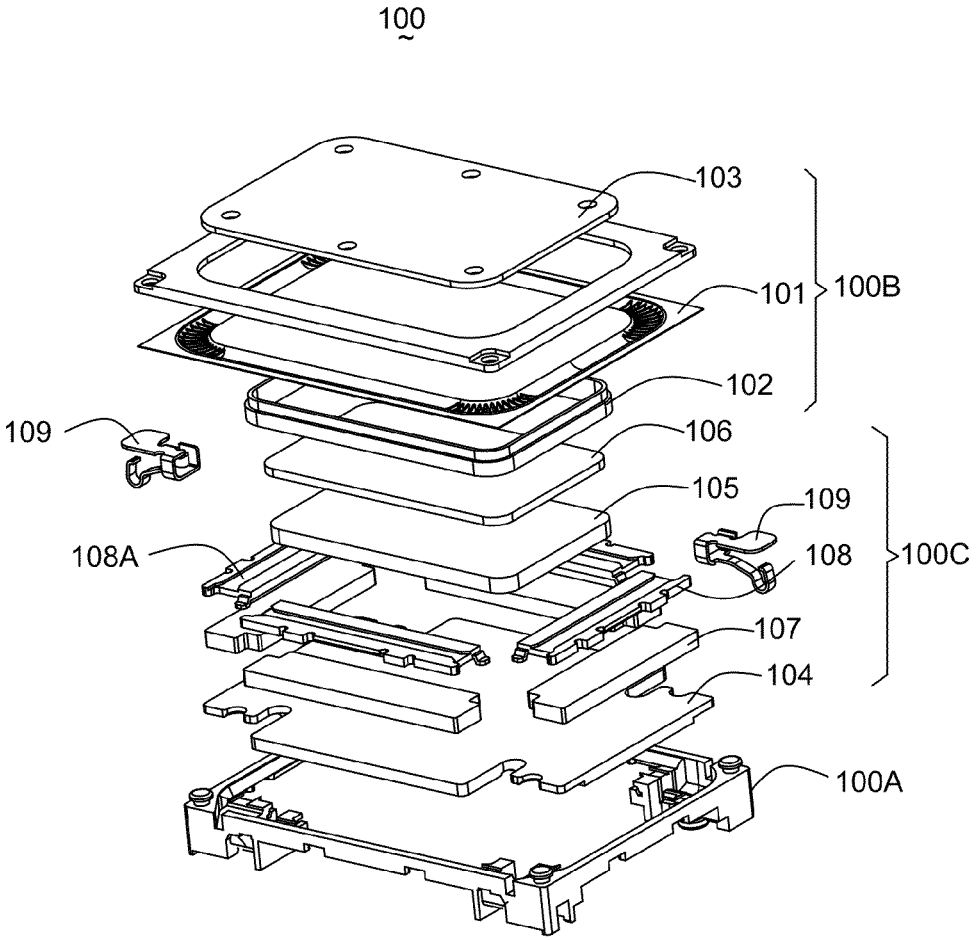
FIG. 1 is an exploded view of an exemplary embodiment of a miniature speaker according to the present disclosure.
Figure 3:
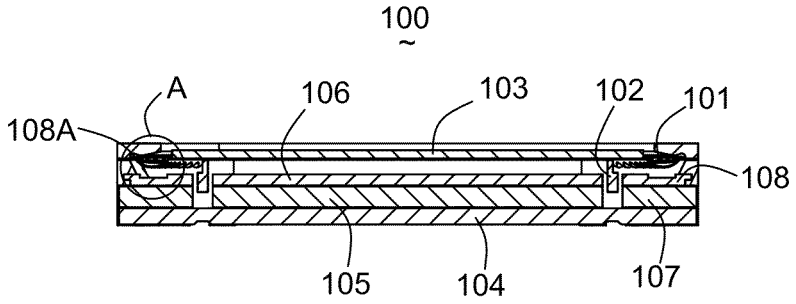
FIG. 3 is a cross-sectional view of the miniature speaker in FIG. 1.

As shown in FIG. 1 and FIG. 3, a miniature speaker 100 comprises a frame 100A, a magnetic circuit system 100C received in the frame 100A, and a vibrating system 100B disposed above the magnetic circuit system 100C and fixed to the frame 100A.

The magnetic system 100C comprises a magnetic yoke 104, a primary magnet assembly disposed on the magnetic yoke 104, a secondary magnetic magnet assembly disposed to surround the primary magnet assembly, and there maintains a magnetic gap between the primary magnet assembly and the secondary magnet assembly. The primary magnet assembly comprises a primary magnet 105 and a pole plate 106 disposed on the primary magnet 105, and the secondary magnet assembly comprises a plurality of secondary magnets 107 disposed to surround the primary magnet 105 and a plurality of splint 108 disposed on the secondary magnets 107 respectively.

Figure 2:
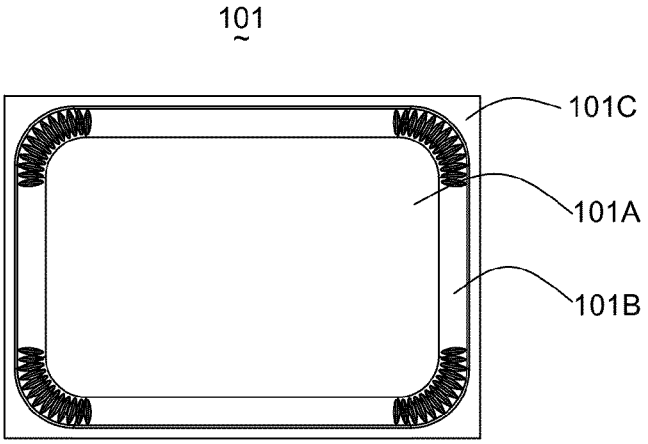
FIG. 2 is a front view of a diaphragm of the miniature speaker in FIG. 1.

The vibrating system 100B comprises a diaphragm 101, a voice coil 102 connected with the diaphragm 101, and a vibrating plate 103 disposed on the diaphragm 101. The voice coil 102 is partially inserted into the magnetic gap and usually has a lead (not labeled), so the miniature speaker 100 further comprises a conductive terminal 109 electrically connected with the lead of the voice coil 102 for electrically connecting the voice coil 102 to an external circuit. As shown in FIG. 2, the diaphragm 101 comprises a vibrating portion for vibration and a fixed portion 101C connected with the vibrating portion and fixed on the frame 100A. The vibrating portion comprises a far portion 101A away from the magnetic circuit system 100C and an adjacent portion 101B adjacent to the magnetic circuit system 100C and connected with the far portion 101A. The adjacent portion 101A is closer to the magnetic circuit system 100C than the far portion 101A, but this is only in a relative concept.

Figure 4:
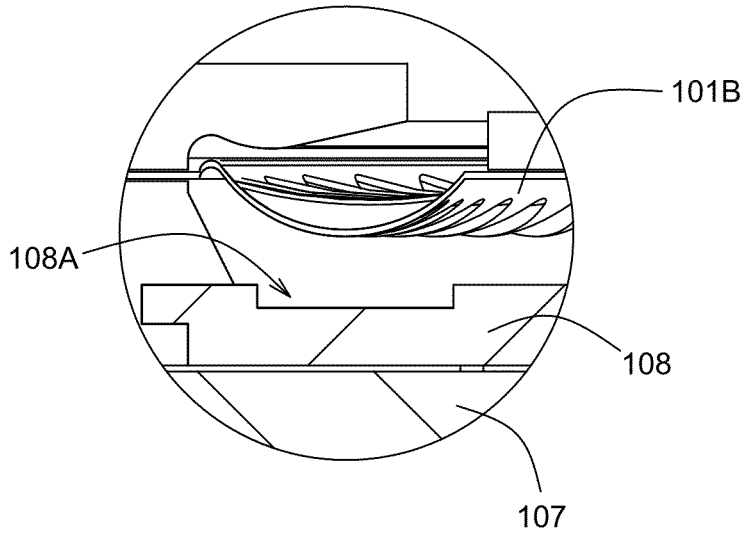
FIG. 4 is an enlarged view of Part A in FIG. 3.

As shown in FIG. 4, the splint 108 opposite to the adjacent plate 101B is provided with an avoid part 108A for avoiding the adjacent portion 101B correspondingly. In this embodiment, the avoid part 108A is a groove recessed on the splint 108 recessed in a direction away from the diaphragm 101, and the groove has a cross section of rectangular form. It can be appreciated that, the cross section of the groove may also have an arc form that matches the cross section of the fixed portion.

The vibrating system 100B has a certain amplitude, and when it operates at the maximum amplitude, the diaphragm would be liable to collision with the magnetic circuit system to produce noises that would compromise the performances if there were no the avoid part. Disposing the avoid part at the position on the splint that corresponds to the adjacent portion allows for greater flexibility in performance design of the miniature speaker and improves the overall performances of the miniature speaker without compromising the maximum amplitude of the miniature speaker.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A miniature speaker, comprising:

a frame, a magnetic circuit system received in the frame, and a vibrating system disposed above the magnetic circuit system and fixed to the frame, the vibrating system comprising a diaphragm comprising a vibrating portion and a voice coil, and the vibrating portion comprising:

a far portion that is away from the magnetic circuit system and connected with the voice coil, and an adjacent portion protruding toward the magnetic circuit system, connected with an edge of the far portion which is spaced from a jointer between the voice coil and the far portion;

wherein an avoid part for preventing the adjacent portion from colliding with the magnetic circuit system while vibrating is disposed at a position on the magnetic circuit system that corresponds to the adjacent portion.

2. The miniature speaker of claim 1, wherein the magnetic circuit system comprises a magnetic yoke, a primary magnetic magnet assembly disposed on the magnetic yoke, and a secondary magnetic magnet assembly disposed to surround the primary magnetic magnet assembly, and the avoid part is located on the secondary magnetic magnet assembly.

3. The miniature speaker of claim 2, wherein the secondary magnetic magnet assembly comprises a plurality of secondary magnetic magnets disposed to surround the primary magnetic magnet assembly and a splints disposed on the secondary magnetic magnets respectively, and the avoid part is located on the splint.

4. The miniature speaker of claim 2, wherein the primary magnetic magnet assembly comprises a primary magnetic magnet disposed on the magnetic yoke and a pole plate disposed on the primary magnetic magnet.

5. The miniature speaker of claim 2, wherein the avoid part is a groove that is recessed in a direction away from the diaphragm on the secondary magnetic magnet assembly.

6. The miniature speaker of claim 5, wherein the groove has a cross-section of rectangle or arc.

7. The miniature speaker of claim 1, wherein the vibrating system further comprises a vibrating plate disposed on the diaphragm.

* * * * *